US005207235A

United States Patent [19]

Müller et al.

[11] Patent Number: 5,207,235

[45] Date of Patent: May 4, 1993

[54] PROCESS AND ROLLER FOR APPLYING A PERM TO PREVIOUSLY PERMED HAIR

[76] Inventors: Siegfried Müller, Bauschengasse 14, D-7737 Bad Dürrheim; Fritz Storz, Ringstrasse 47, D-7057 Winnenden, both of Fed. Rep. of Germany

[21] Appl. No.: 687,862

[22] PCT Filed: Nov. 29, 1989

[86] PCT No.: PCT/DE89/00736

§ 371 Date: May 29, 1991

§ 102(e) Date: May 29, 1991

[87] PCT Pub. No.: WO90/06071

PCT Pub. Date: Jun. 14, 1990

[30] Foreign Application Priority Data

Nov. 29, 1988 [DE] Fed. Rep. of Germany ..... 3840149
Mar. 17, 1989 [DE] Fed. Rep. of Germany ..... 3908733

[51] Int. Cl.[5] ..... A45D 7/04

[52] U.S. Cl. ..... 132/207; 132/210; 132/245; 132/246; 132/247

[58] Field of Search ..... 132/235, 239, 242, 245, 132/246, 247, 249, 253, 254, 264, 207, 210

[56] References Cited

U.S. PATENT DOCUMENTS

| | | | |
|---|---|---|---|
| 2,157,244 | 5/1939 | Pisciotta | 132/239 |
| 2,525,750 | 10/1950 | Spencer | 132/253 |
| 4,027,684 | 6/1977 | Mueller . | |
| 4,540,006 | 9/1985 | Collis | 132/246 |
| 4,546,781 | 10/1985 | Schmitz | 132/239 |
| 4,605,021 | 8/1986 | Hodson et al. | 132/249 |
| 4,648,414 | 3/1987 | Fox et al. | 132/246 |
| 4,834,118 | 5/1989 | Goeller . | |
| 4,844,103 | 7/1989 | Vick et al. | 132/246 |

FOREIGN PATENT DOCUMENTS

| | | | |
|---|---|---|---|
| 131434 | 1/1933 | Austria | 132/245 |
| 524026 | 5/1931 | Fed. Rep. of Germany | 132/239 |
| 2501935 | 1/1976 | Fed. Rep. of Germany . | |
| 3234672 | 8/1983 | Fed. Rep. of Germany . | |
| 3539803 | 5/1986 | Fed. Rep. of Germany . | |
| 8600201 | 1/1986 | PCT Int'l Appl. | 132/242 |
| 363446 | 9/1962 | Switzerland | 132/245 |
| 2116032 | 9/1983 | United Kingdom . | |

*Primary Examiner*—Gene Mancene
*Assistant Examiner*—Frank A. LaViola
*Attorney, Agent, or Firm*—Flynn, Thiel, Boutell & Tanis

[57] ABSTRACT

Using rollers having roller members which are adjacent on both sides to a center flexible longitudinal section capable of remaining in a respective bent position and have at each end an outer longitudinal section, previously perm or water-waved (pretreated) hair sections of a strand of hair are spirally rolled up, starting with the tips of the hair, first onto one outer longitudinal section, continuing then also onto the center longitudinal section, and finally the previously untreated hair section (hairline) is rolled substantially onto the other outer longitudinal section. The one outer longitudinal section is then bent approximately normally relative to the other outer longitudinal section such that the one outer longitudinal section and a portion of the center longitudinal section with the rolled-up previously treated hair section project substantially vertically upwardly from the head. Intensive-action perm or water-wave liquid is then applied only to the previously untreated hair section (hairline) rolled up substantially onto the other outer longitudinal section. The roller member of a roller (1) particularly suited for carrying out the process has a first longitudinal section (2) made of a substantially rigid material, which a fixing element (9, 10) is arranged on or engages. The first longitudinal section (2) is connected at one end to a second flexible longitudinal section (3) made of a flexible member (5) of a viscoelastic plastic, which flexible member (5) is arranged around a wire core (4).

22 Claims, 2 Drawing Sheets

PROCESS AND ROLLER FOR APPLYING A PERM TO PREVIOUSLY PERMED HAIR

FIELD OF THE INVENTION

This invention relates to a process and a roller for applying a perm or water-wave to previously permed or water-waved hair.

BACKGROUND OF THE INVENTION

The invention relates to a known process for applying a perm or water wave to previously permed or water-waved hair using rollers, the roller members of which, being adjacent on both sides to a center, flexible longitudinal section capable of remaining in a respective bent position, each have an outer longitudinal section, with each one hair strand being rolled onto the roller member starting with the tips of the hair, the roller member being then securely fixed against rotation relative to adjacent rollers and/or the head, and a perm or water-wave liquid being thereafter applied onto the rolled-up hair. The invention relates furthermore to a roller, which is supposed to be particularly suited to carry out this process. The invention includes an improvement to a conventional roller for perm or water-waves having a roller member preferably provided with openings, onto the outer surface of which roller member a strand of hair can be rolled up, and having a fixing element engaging the roller member, with which fixing element the roller member with the rolled up strand of hair can be securely fixed against rotation relative to adjacent rollers and/or the head.

In one type of roller for perms or water waves, the roller member as a whole is made of a substantially rigid material, in most cases a plastic. After strands of hair divided from the remaining hair have been rolled up to the hairline onto the outer surface of the roller member by rotating the roller member about its axis, the roller member with the rolled up hair strand must be fixed against unrolling. Various types of fixing elements exist for this purpose. In the case of one known perm or water-wave roller (German Patent No. 25 01 935), two flanges arranged at an axial distance from one another and having the same axial thickness are provided at one or both ends of the roller member and an annular groove is provided between both flanges, the width of the groove being slightly less than the thickness of the flange. To fix the roller, one flange of the adjacent roller is pressed in the groove with a clamping action.

The roller member has in other known rollers for creating perms and water waves latticed openings. A needle is used as the fixing element. After one strand of hair has been rolled up onto the roller member, the needle is placed through the rolled-up strand of hair and the openings in the roller member. It can then in addition also be placed into the openings of an already fixed adjacent roller or it can be supported with its end on the head.

Furthermore, rollers are also known which have on one or both ends a holding lever rotatable about the longitudinal axis of the roller member, with a spring-biased ratchet being provided between the holding lever and roller member. After the strand of hair has been rolled up onto the roller member, the holding lever is supported on the head and the spring-biased ratchet prevents the roller from unrolling.

The roller member of a different type of roller includes a center wire core and a flexible member of a viscoelastic plastic surrounding the wire core (German Patent No. 35 39 803 and German Offelengungsschrift No. 32 34 672). The strand of hair in this type of roller is with a straight roller member rolled onto a portion of the roller member such that another portion remains free. When the rolling up to the hair-line is done, the hair-free portion of the roller member is bent and the bent portion is then supported on the head or on an adjacent roller. The center wire core keeps the bent portion in the bent position.

The portion of the roller member which carries the rolled-up strand of hair rests in all of these rollers flat on the head. This has the result that, when perm or water-wave liquid is applied, the entire rolled-up strand of hair is soaked with the liquid from the tips of the hair to the hairline. This is by all means correct for hair which has not been previously treated with a perm or water wave. However, in the case of hair which has already had one or more perm or water-wave treatments, the structure of the hair is damaged at the tips of the hair and in the center portions of the hair by the repeated treatment with a perm or water-wave liquid. In contrast, no damage to the structure of the hair occurs at the hairline, where in the meantime smooth new hair sections have grown, because the newly grown hair sections have previously not been treated with a perm or water-wave liquid. The damage to the structure of the hair is evidenced by the hair loosing its shine at the tips and in the center area, becoming frizzy, and not forming pretty curls.

A basic purpose of the invention is to provide a process for applying a perm or water wave to previously permed or water waved hair of the above-mentioned type, which process substantially avoids damage to the hair structure of the previously permed or water-waved hair even during repeated perm or water-wave treatment and can thereby be carried out easily. A further purpose of the invention is to provide a roller which is particularly suited to carry out this process.

SUMMARY OF THE INVENTION

The process of the invention is that previously permed or water-waved (pretreated) hair sections of the strand of hair are, starting with the tips of the hair, spirally rolled first onto one outer longitudinal section, and then progressively also onto the center longitudinal section, and finally the untreated section of hair is spirally rolled substantially onto the other outer longitudinal section, the one outer longitudinal section then being bent approximately at a right angle relative to the other outer longitudinal section such that the one outer longitudinal section and a portion of the center longitudinal section with the rolled-up previously treated hair sections project substantially vertically upwardly from the head, and intensive-action perm or water-wave liquid then being applied to the not previously treated hair section (hairline), which is substantially rolled up onto the other outer longitudinal section.

By rolling first the previously treated hair sections of a strand of hair and thereafter also the newly grown and chemically untreated hair section spirally onto the various longitudinal sections of the roller member, this process achieves that previously treated and untreated sections lie at different areas of the roller member. With the vertical bending of the one outer longitudinal section relative to the other outer longitudinal section, the bending being done such that the one outer longitudinal section projects substantially vertically upwardly from the head, it is achieved that the previously treated hair sections lie clearly above the area, in which the previously untreated hair sections lie. Thus it is easy to differentiate between the previously treated and untreated hair sections, and intensive-action liquid is then applied only to the previously untreated hair sections lying directly on the head, while the longitudinal sections carrying the previously treated hair sections project from the treating liquid and do not come into contact with the liquid. The treating liquid is here understood to be a relatively intensive-action perm or water-wave liquid. Since the previously treated hair sections are above the area of the previously untreated hair sections, it is also prevented that the treating liquid flows from the previously untreated hair sections to the previously treated hair sections. Also, intensive-action liquid is not applied to those hair sections which are on the upwardly bent longitudinal sections. Thus, it is prevented that previously permed or water-waved hair sections come into contact with the intensive-action liquid. Thus, damage to the hair is with certainty avoided. In contrast, the newly-grown smooth hair sections, which had previously not been treated with a perm or water-wave liquid, are soaked in the desired manner with the intensive-action liquid.

The process can also be carried out such that a mild-action perm or water-wave liquid or, if necessary, also a care liquid is applied to the previously treated hair sections, which are rolled up onto the substantially vertically upwardly projecting longitudinal sections. It is possible with the mild-action liquid to carefully activate the remaining perm existing in the previously treated tips of the hair and the center hair section, when this is necessary. However, it is also possible to apply a care product to the previously treated hair sections. If necessary, it would also be possible to apply a blocking liquid to the previously treated hair sections, which liquid prevents the relatively watery treating liquid applied to the previously untreated hair sections from penetrating, through capillary action, into the previously treated hair sections. This blocking liquid also prevents the previously treated hair sections from coming into contact with intensive-action liquid when, during its application to previously untreated hair sections, the liquid is applied by mistake to part of the previously treated hair sections.

The process of the invention can be suitably carried out with a conventional roller, the roller member of which consists over its entire length of a center wire core and a flexible member of viscous elastic plastic surrounding the wire core (German Patent No. 35 39 803 and German Offenlegungsschrift No. 32 34 672). When using such a roller member the strand of hair would have to be spirally rolled up over almost the entire length of the roller member, then a portion of the roller member, on which no hair is rolled up, would have to be bent such that it is supported on the head or an adjacent roller, and another longitudinal section on which previously treated hair sections exist would have to be bent such that it projects substantially vertically upwardly from the head. Since this handling, however, requires some skill both during rolling up and also during bending, the invention has also as a basic purpose to provide a roller which is particularly suited to carry out the method.

Starting out from a roller for perms and water waves of the above-mentioned type, this is achieved by the roller member having a first longitudinal section made substantially of a rigid material, on which longitudinal section the fixing element is arranged or engages, and by the first rigid longitudinal section being connected at one end to a second flexible longitudinal section which is made of a viscoelastic plastic arranged around a center wire core so that, after being bent, it remains in the bent position.

Hair, which has previously been permed or water-waved, is rolled up onto the flexible longitudinal section of the roller member starting with the tips of the hair. The center section of the hair with the exception of the smooth hairline is also rolled up onto the flexible longitudinal section. The smooth, previously not permed or water-waved hairline is then rolled up onto the rigid first longitudinal section of the roller member. After the strand of hair is rolled up to the hairline, the roller member is fixed by means of the fixing element relative to adjacent rollers and/or the head so that it is fixedly held against rotation. The flexible longitudinal section with the rolled up, previously permed or water-waved section of the strand of hair is thereafter bent vertically upwardly. The perm or water-wave liquid is then only applied to the hair section rolled up on the rigid longitudinal section, whereas perm or water-wave liquid is not applied to those hair sections which are on the upwardly bent flexible longitudinal section. In order for the treating liquid not to flow due to capillary action from the hair sections to be treated into the hair sections not to be treated, it is advantageous to use a perm or water-wave liquid with a correspondingly higher viscosity, thus avoiding or at least reducing the capillary action. Thus the new roller has the important advantage that perm or water-wave liquid can be kept away from hair sections which had previously received a perm or water-wave treatment. Moreover, the new roller is easily and quickly handled.

Advantageous developments of the invention are recited in the subclaims.

BRIEF DESCRIPTION OF THE DRAWINGS

The invention will be discussed in greater detail hereinafter in connection with several exemplary embodiments illustrated in the drawings, in which.

DETAILED DESCRIPTION

Figure 1:
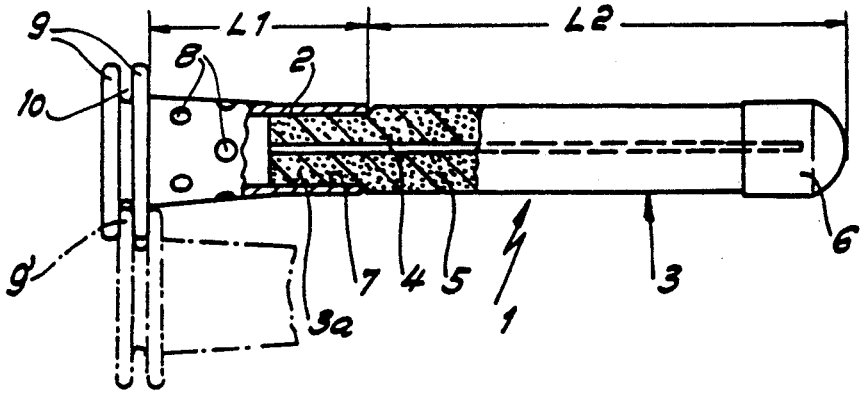
FIG. 1 is a side view of a first exemplary embodiment, partially in cross section.

The roller 1 for perms and water waves illustrated in FIG. 1 includes a first, substantially rigid longitudinal section 2, which is preferably manufactured of plastic, and of a second, flexible longitudinal section 3. Both longitudinal sections 2, 3 are fixedly connected to one another. FIGS. 1–4 show the rollers each in a straight, nonbent position. The flexible longitudinal section 3 has a wire core 4, which, if necessary, can also be covered with plastic. The wire core 4 is covered with a flexible member 5 of a viscoelastic plastic. This plastic can be a soft foam with a polyethylene or polyurethane base. The surface of the member 5 should thereby be closed so that perm or water-wave fluid does not penetrate into said member. The flexible longitudinal section 3 is in this manner designed such that, after being bent, it remains in the bent position. An end cap 6 of plastic can be arranged on the free end of the flexible longitudinal section 3. The flexible section 3 has an advantageous cylindrical shape in the illustrated exemplary embodiments. However, other cross-sectional shapes are also possible. It is also possible to design the flexible longitudinal section 3 such that it widens conically toward its free end. To connect the flexible longitudinal section 3 to the rigid longitudinal section 2, the latter has a recess 7, into which extends one end 3*a* of the flexible longitudinal section 3. The end 3*a* is advantageously glued in the recess 7. However, it may also be held by a clamping force or by form-locking structure. When the flexible longitudinal section 3 is cylindrically designed, the recess 7 is then also advantageously cylindrical.

The rigid longitudinal section 2 can have holes 8. It is used to connect or rather to mount a fixing element. Two flanges of the same axial thickness arranged axially spaced from one another and an annular groove 10 between said flanges, the width of which is slightly less than the thickness of one flange, are provided at the free end of the rigid longitudinal section 2 in the exemplary embodiment illustrated in FIGS. 1 and 2. One flange 9' of an adjacent roller can be pressed under clamping action into this annular groove 10. It is possible in this manner to rotationally fixedly secure one roller 1 with respect to the adjacent roller. More details regarding the design of the flange 9 and the annular groove 10 are described in German Patent No. 25 01 935.

The effective length L2 of the flexible longitudinal section 3 is preferably twice the effective length L1 of the rigid longitudinal section 2. Since it is, however, mainly only important that the rigid longitudinal section 2 carries the fixing element or is suited for engagement by the fixing element, the rigid longitudinal section 2 can also be shorter in the exemplary embodiments illustrated in FIGS. 1 and 2.

In the exemplary embodiments illustrated in FIGS. 2–4 and described hereinafter, parts having the same function are each identified with the same reference numerals used in the description of the exemplary embodiment illustrated in FIG. 1. Thus the above description applies logically also for the exemplary embodiments illustrated in FIGS. 2–4.

Figure 2:
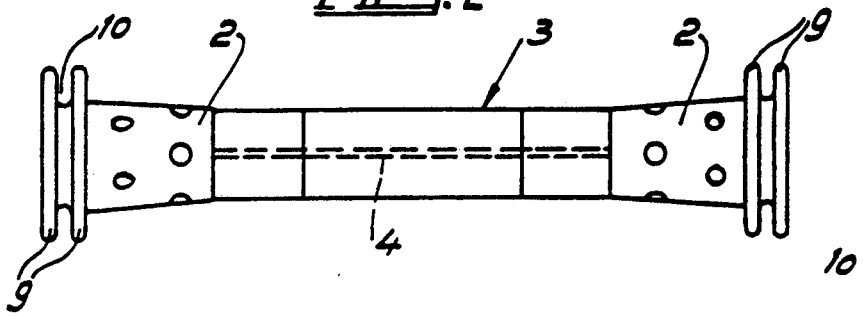
FIGS. 2 to 4 are side views of three further exemplary embodiments.

The two ends of the flexible longitudinal section 3 are each connected to a respective rigid longitudinal section 2 in the exemplary embodiment illustrated in FIG. 2. The connection can be done in a similar manner as has been described above. The longitudinal sections 2 correspond in the exemplary embodiment illustrated in FIG. 2 in their design to the longitudinal section 2 of the aforedescribed exemplary embodiment. However, they can also be designed like the longitudinal sections 2*a* or 2*b* of the exemplary embodiments illustrated in FIGS. 3 and 4.

Figure 3:
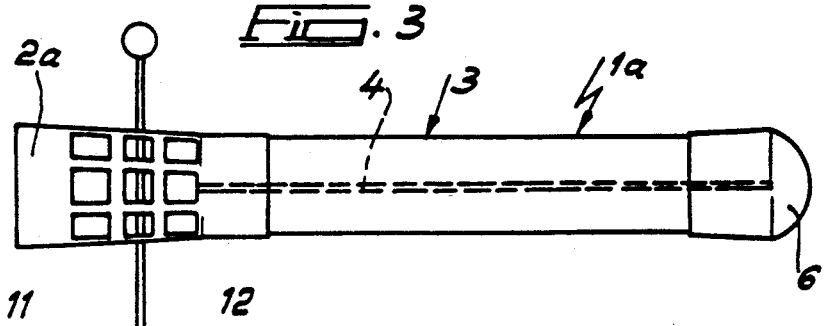

The rigid longitudinal section 2*a* has latticed openings 11 in the exemplary embodiment illustrated in FIG. 3. This rigid longitudinal section 2*a* can also consist of plastic. The connection to the flexible longitudinal section 3 can occur in the above-described manner. A needle 12 is used as the fixing element, which needle can be placed through the openings 11. The needle 12 can, in order to fix a roller after a strand of hair has been wound thereon, be placed through the openings 11 of the roller and can also be inserted into suitable openings in the rigid longitudinal section of an adjacent roller. Both rollers are in this manner securely fixed against rotation. However, it is also possible to place the needle 12 simply through the openings 11 of a longitudinal section 2*a* and to permit the end of the needle to rest on the head. The roller 1*a* is also in this case secured against rotation.

Figure 4:
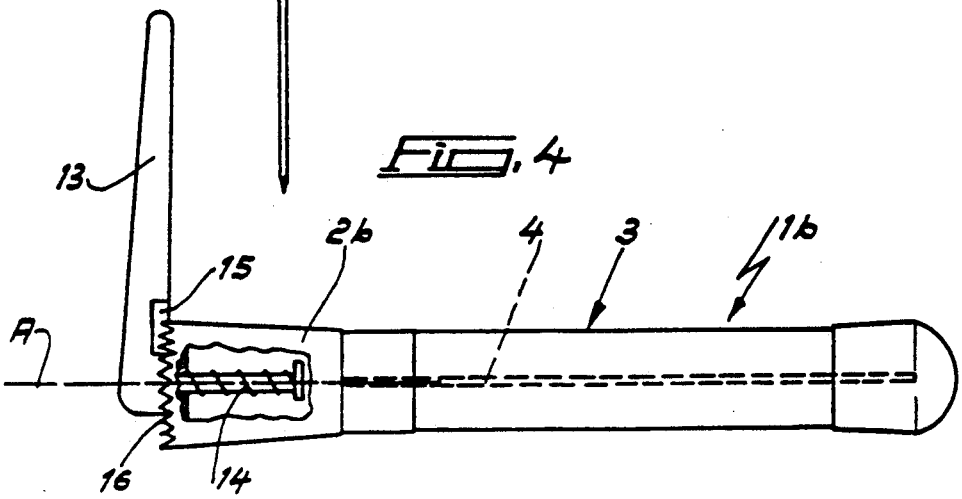

A holding lever 13 extending radially with respect to the longitudinal axis A of the longitudinal section 2*b* and rotatable about the longitudinal axis is provided at the free end of the said rigid longitudinal section 2*b* in the exemplary embodiment illustrated in FIG. 4. A ratchet 15, 16 biased by a spring 14 is provided between the holding lever 13 and the longitudinal section 2. The ratchet includes a plurality of teeth 16 provided on the free end of the rigid longitudinal section 2*b* and a key 15 provided on the holding lever 13 and fitting into the tooth gaps. The spring 14 presses the key 15 into the tooth gaps between the teeth 16 and thus secures the holding lever 13 against rotation relative to the longitudinal section 2*b*. The holding lever 13 can be rotated with some resistance relative to the longitudinal section 2*b* during rolling up of a strand of hair. The teeth can also be designed saw-toothlike so that the rotation of the holding lever 13 is made easier in one direction and is blocked in the other. After a strand of hair has been rolled up to the hairline, the free end of the holding lever 13 is supported on the head and thus secures the roller 1*b* against rotation.

The rigid longitudinal sections 2, 2*a*, 2*b* can have any desired cross sections and they can also correspond in longitudinal direction to shapes of common rollers, for example they can be cylindrical or conical.

Figure 5:
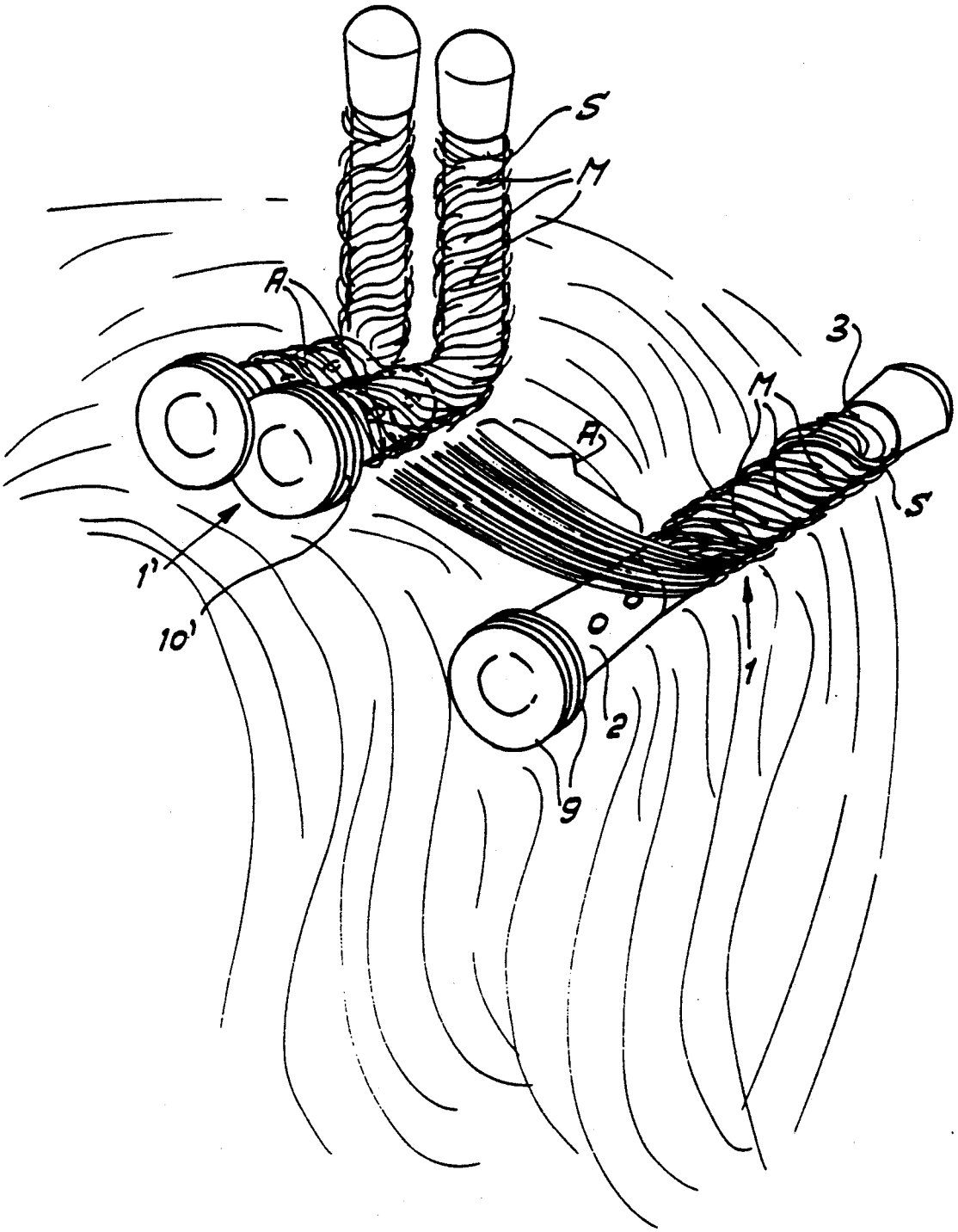
FIG. 5 is a diagrammatic illustration of the use of the new rollers.

The use of the new roller will be described hereinafter in connection with FIG. 5. It is hereby assumed that hair, which has already received one or more perm or water-wave treatments, is supposed to be treated again with a perm or water-wave. Such a renewed treatment is necessary since the hair, after an earlier perm or water-wave treatment, has in the meantime grown approximately 4–8 cm, depending on how long ago the earlier treatment took place. This new growth at the hairline is smooth, while the center section and the tips of the hair are still curly from the preceding treatment. Thus it is not necessary for these earlier treated hair sections to be again softened and shaped by applying a perm or water-wave liquid. In order to avoid damage to the condition of the hair of the earlier treated hair sections, it is advantageous that these earlier treated hair sections do not again come into contact with the perm or water-wave liquid.

In order to achieve this, one starts to spirally or, more exactly stated, helically roll up the tips S of hair at the free end of the flexible longitudinal section 3 and then also the earlier treated center section M onto the flexible longitudinal section 3. This rolling up onto the flexible longitudinal section 3 continues until the entire, already earlier perm or water-wave treated hair sections are rolled up onto the flexible section 3 and only the hair section A with smooth hair at the hairline remains. This hair section A, which has not previously been perm or water-wave treated, is finally mostly rolled up onto the rigid longitudinal section 2. It is also possible to roll up yet a portion of the hair section A onto the flexible longitudinal section 3 near the rigid longitudinal section 2, should the rigid longitudinal section 2 not be sufficient for rolling up all of the smooth hair section A. After the entire hair length has been rolled, up to the hairline, onto the roller 1, said roller 1 is fixed to an already earlier rolled-up adjacent roller 1'. This is done in the earlier-described manner such that one of the flange 9 is pressed into the annular groove 10' of the adjacent roller 1'. The portion of the flexible longitudinal section 3, onto which the already earlier treated hair sections S and M are rolled, is subsequently bent upward at a right angle, as this is illustrated on the left in FIG. 5. The flexible longitudinal sections 3 with the rolled-up hair sections S and M thus project vertically from the head. The perm or water-wave liquid is thereafter applied only to the not previously treated hair section A, which is provided substantially on the rigid longitudinal section 2, and possibly onto a portion of the flexible longitudinal section. Bending the flexible longitudinal sections 3 vertically upwardly ensures that the earlier treated hair sections S and M project from the treatment liquid or rather do not come into contact with said liquid. To prevent treatment liquid from also entering through capillary action the hair sections M and S, it is advantageous to use a perm or water-wave liquid with a higher, almost gel-like viscosity. The new roller can, if necessary, also be used to color the tips of the hair. The hair is also in this case rolled up and the flexible longitudinal section bent upwardly as described above. Color is then in this case applied onto those hair sections which are on the upwardly bent longitudinal section.

The embodiments of the invention in which an exclusive property or privilege is claimed are defined as follows.

1. In a process for applying a perm or water wave to previously permed or water-waved hair using rollers, the roller members of which, being adjacent on both sides to a center flexible longitudinal section capable of remaining in a respective bent position, each have an outer longitudinal section, including the steps of rolling a hair strand on ahead onto the roller member starting with the tips of the hairs, then securing the roller member relative to the head and thereafter applying a perm or waterwave liquid onto the rolled-up hair, the improvement comprising the steps of spirally rolling previously permed or water-waved sections of the strand of hair, starting with the tips of the hair, first onto a first of said outer longitudinal sections, and then progressively also onto the center longitudinal section, and finally spirally rolling the untreated section of hair substantially onto a second of said outer longitudinal sections, then bending the roller member until said first outer longitudinal section extends approximately at a right angle relative to said second outer longitudinal section such that said first outer longitudinal section and a portion of the center longitudinal section with the rolled-up previously treated hair sections project substantially perpendicularly outwardly from the head, and then applying intensive-action perm or water-wave liquid to the previously untreated hair section which is rolled up substantially onto said second outer longitudinal section.

2. A process according to claim 1, including the step of applying a mild-action perm or water-wave liquid or a care liquid to the previously treated hair sections which are rolled up onto said first outer longitudinal section and said portion of said center longitudinal section.

3. In a roller for perms or water waves, comprising a roller member having an outer surface onto which strands of hair on a head can be rolled, and a fixing element with which the roller member with the rolled-up strand of hair can be securely fixed against rotation relative to the head, the improvement comprising wherein the roller member has a first longitudinal section made of a substantially rigid material, with which first longitudinal section the fixing element cooperates, said rigid first longitudinal section having an outer surface onto which a portion of said strands of hair are rolled, and wherein said rigid first longitudinal section is connected at one end to a second longitudinal section which is a flexible member of a visoelastic plastic, the flexible member being arranged around a center wire core so that, after being bent, said second longitudinal section remains in the bent position.

4. A,roller according to claim 3, wherein the flexible longitudinal section is cylindrical.

5. A roller according to claim 4, wherein one end of the flexible longitudinal section extends into a recess in the rigid longitudinal section and is secured therein.

6. A roller according to claim 5, wherein the recess is cylindrical.

7. A roller according to claim 5, wherein said one end of said flexible longitudinal section is glued in said recess.

8. A roller according to claim 5, wherein said one end of said flexible longitudinal section is force-lockingly secured in said recess.

9. A roller according to claim 5, wherein said one end of said flexible longitudinal section is form-lockingly secured in said recess.

10. A roller according to claim 3, wherein the flexible longitudinal section is conically widened toward its free end.

11. A roller according to claim 3, wherein an end cap is arranged at a free end of the flexible longitudinal section.

12. A roller according to claim 3, wherein an end of the flexible longitudinal section remote from said second longitudinal section is connected to a third longitudinal section made of a substantially rigid material.

13. A roller according to claim 3, wherein a free end of the rigid longitudinal section has two flanges having the same axial thickness and arranged axially spaced from one another, and has an annular groove provided between said two flanges, the width of said annular groove being slightly less than the thickness of one of said flanges so that a flange of an adjacent roller can be pressed under clamping action into said annular groove.

14. A roller according to claim 3, wherein the rigid longitudinal section has latticed openings and including a needle which can be placed through the openings, and serves as the fixing element.

15. A roller according to claim 3, wherein a holding lever extending radially with respect to a longitudinal axis of the rigid longitudinal section and being rotatable about said longitudinal axis is provided on a free end of said rigid second longitudinal section, and a spring-loaded ratchet is provided between the holding lever and the second longitudinal section.

16. A roller according to claim 3, wherein the effective length of the flexible first longitudinal section is approximately twice the effective length of the rigid second longitudinal section.

17. A roller according to claim 3, wherein the rigid longitudinal section is made of a plastic.

18. A roller according to claim 3, wherein said rigid first longitudinal section has a plurality of holes therein.

19. A process for applying a perm or water wave to a strand of hair on a head using a roller member which includes a flexible first section capable of remaining in a respective bent position and includes a rigid second section coupled to one end of said first section, comprising the steps of rolling onto said first section of said roller member a portion of the strand of hair spaced from the head and rolling onto said second section a second portion of the strand of hair adjacent said head, and thereafter applying a perm or water wave liquid to said second portion of said strand which is on said rigid second section.

20. A process of claim 19, including the step of providing in said rigid second section a plurality of holes.

21. A method according to claim 19, wherein said rolling steps are carried out so that said first portion of said strand is a previously permed or water waved part of the strand and said second portion is a part which has not been previously permed or water waved.

22. A process according to claim 19, including after said rolling steps and prior to said applying step the step of bending said flexible first section of said roller member so that a portion thereof remote from said second section extends at approximately a right angle to a portion thereof adjacent said second section and extends approximately perpendicular to the head.

* * * * *

UNITED STATES PATENT AND TRADEMARK OFFICE

CERTIFICATE OF CORRECTION

PATENT NO. : 5 207 235

DATED : May 4, 1993

INVENTOR(S) : Siegfried MÜLLER et al

It is certified that error appears in the above-identified patent and that said Letters Patent is hereby corrected as shown below:

Column 7, line 34; change "on ahead" to ---on a head---.

Column 7, line 43; after "hair" insert ---(hairline)---.

Column 7, line 53; after "section" insert ---(hairline)---.

Signed and Sealed this

Fourteenth Day of December, 1993

Bruce Lehman

*Attest:*

BRUCE LEHMAN

*Attesting Officer*

*Commissioner of Patents and Trademarks*